US006266910B1

(12) United States Patent
Horine

(10) Patent No.: US 6,266,910 B1
(45) Date of Patent: Jul. 31, 2001

(54) LAP WEAPON HOLDER

(76) Inventor: Ray L. Horine, 14900 Beyl Rd., Borden, IN (US) 47106

( * ) Notice: Subject to any disclaimer, the term of this patent is extended or adjusted under 35 U.S.C. 154(b) by 0 days.

(21) Appl. No.: 09/399,277

(22) Filed: Sep. 17, 1999

Related U.S. Application Data

(60) Provisional application No. 60/104,093, filed on Oct. 13, 1998.

(51) Int. Cl.[7] ..... F41A 23/18
(52) U.S. Cl. ..... 42/94; 224/192; 224/250
(58) Field of Search ..... 42/94

(56) References Cited

U.S. PATENT DOCUMENTS

| | | | | |
|---|---|---|---|---|
| D. 369,674 | | 5/1996 | Schreiner et al. . | |
| 1,469,285 | * | 10/1923 | Thompson | 42/94 |
| 3,022,898 | * | 2/1962 | Loeb | 3/64 |
| 3,208,653 | | 9/1965 | Wallace . | |
| 3,869,074 | * | 3/1975 | Roach | 224/1 R |
| 3,963,156 | * | 6/1976 | Perrin | 224/1 R |
| 4,121,743 | | 10/1978 | Burton . | |
| 4,410,118 | * | 10/1983 | Taurisano | 224/222 |
| 4,544,089 | * | 10/1985 | Tabler | 224/192 |
| 4,628,893 | | 12/1986 | Shaw, III . | |
| 4,684,047 | | 8/1987 | Burgwin . | |
| 4,787,540 | * | 11/1988 | Barry | 224/192 |
| 5,685,103 | * | 11/1997 | Wiggins | 42/94 |
| 5,697,537 | | 12/1997 | Bowslby . | |
| 5,711,467 | | 1/1998 | Brown, Sr. . | |
| 5,718,363 | * | 2/1998 | Graves | 224/250 |
| 5,894,976 | * | 4/1999 | Harper | 224/587 |

* cited by examiner

*Primary Examiner*—Charles T. Jordan
*Assistant Examiner*—John Richardson
(74) *Attorney, Agent, or Firm*—Stites & Harbison, PLLC; David W. Nagle, Jr.; Vance A. Smith

(57) ABSTRACT

A holder for a hunting rifle or other weapon is comprised of a pair of identical assemblies, each of which is adapted to be secured to an individual's thigh. Secured to an individual's thighs, these two assemblies provide a convenient holder for supporting a rifle or other weapon in a position across the individual's lap, thereby freeing the individual's hands to perform other tasks. The weapon, however, is still advantageously positioned so that the individual has ready access to the weapon should game suddenly appear.

14 Claims, 4 Drawing Sheets

LAP WEAPON HOLDER

BACKGROUND OF THE INVENTION

This application claims priority from U.S. provisional application 60/104,093 filed Oct. 13, 1998.

The present invention relates to a holder for a hunting rifle or other weapon, a holder that maintains the weapon in a readily accessible position.

When hunting deer or similar game, hunters often conceal themselves in a ground blind or in a tree to provide them with a clear view of approaching game and to allow them to realize a clear shot at such approaching game. For example, many hunters employ a tree stand, an elevated platform secured to a tree. Such tree stands enable the hunter to rest, typically in a sitting position, while waiting for game to approach. A typical example of such a tree stand is described and illustrated in U.S. Pat. No. 4,802,552 issued to Williams, which is incorporated herein by reference for its detailed description of a tree stand.

While sitting and waiting for game to approach, whether it be in a tree stand or in a ground blind, a hunter may want to eat his lunch, warm his hands, or perform another activity requiring the use of his hands. Such activities require that he put his weapon down. Perhaps, the hunter will choose to place his weapon on the floor of the tree stand or will rest it against the tree. If game were to suddenly approach, however, the hunter must quickly retrieve his weapon and prepare it for firing. Unfortunately, rapid motions associated with such retrieval may frighten the game, may create sounds which frighten the game, or may even affect the ability to expeditiously and accurately use the weapon itself.

Various prior art devices have been developed for holding and securing weapons such as a rifle or an archery bow. However, most such devices are designed for attachment to the tree stand or the tree itself, and thus still do not adequately provide for quick and effortless retrieval of the weapon. Other devices are complex in construction and may be difficult to assemble or use. See, for example, U.S. Pat. No. 4,936,415 issued to Williams.

It is thus a paramount object of the present invention to provide a weapon holder that places the weapon in a readily accessible position, thereby allowing for quick and effortless retrieval of the weapon.

This and other objects and advantages will become readily apparent upon a reading of the description herein along with the appended drawings.

SUMMARY OF THE INVENTION

The present invention is a holder for a hunting rifle or other weapon that allows the individual to position the weapon across his lap when he is in a sitting position, thereby freeing his hands to perform other tasks. The preferred weapon holder is comprised of a pair of identical assemblies, each of which is adapted to be secured to an individual's thigh. Secured to an individual's thighs, these two assemblies cooperate to provide a convenient holder for supporting and securing a rifle or other weapon in a position across the individual's lap. The weapon, however, is still advantageously positioned so that the individual has ready access to the weapon should game suddenly appear.

DESCRIPTION OF THE PREFERRED EMBODIMENTS

Figure 1:
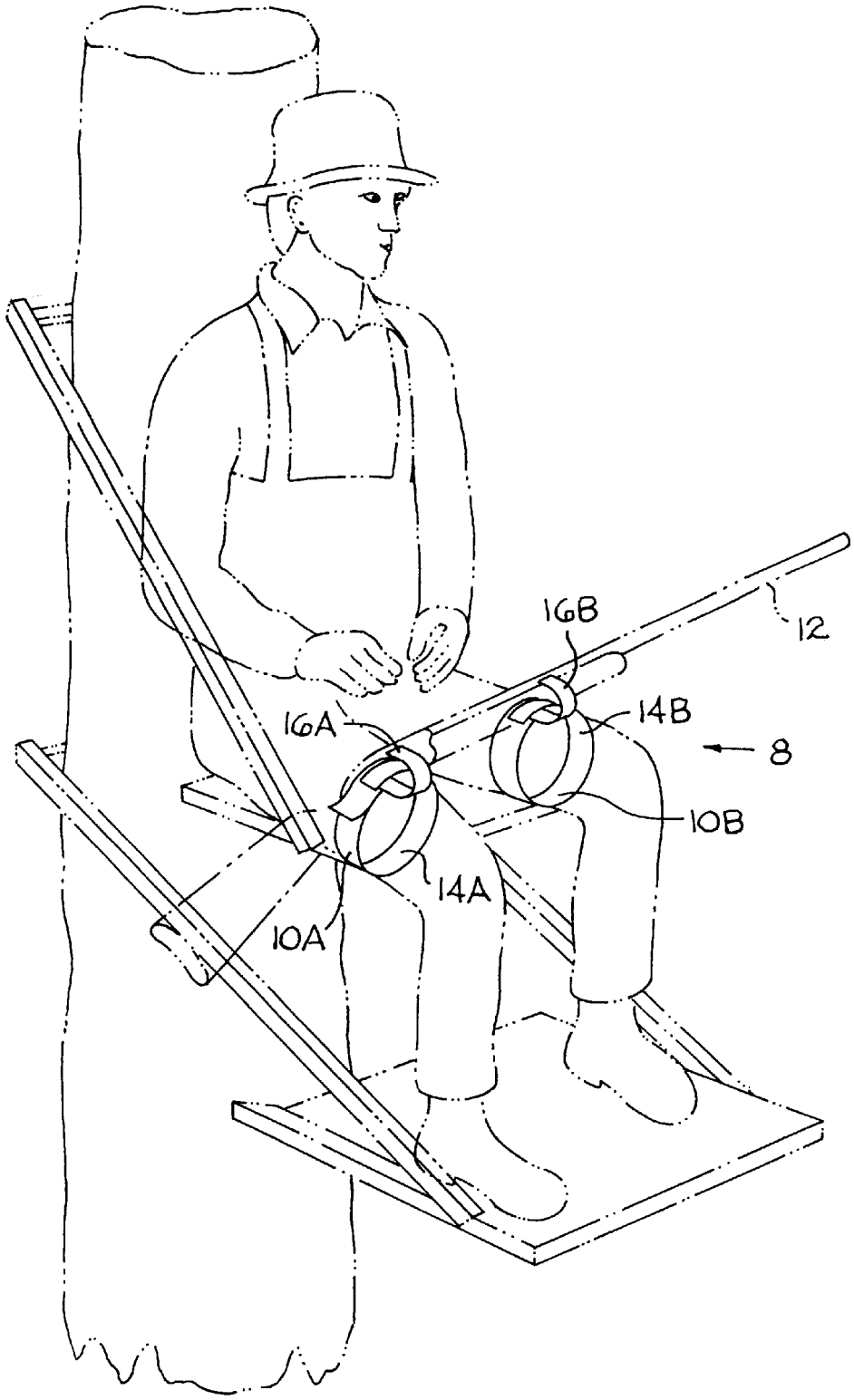
FIG. 1 is a perspective view of a preferred embodiment of the weapon holder of the present invention being worn and utilized by a hunter (depicted in phantom)
Figure 2:
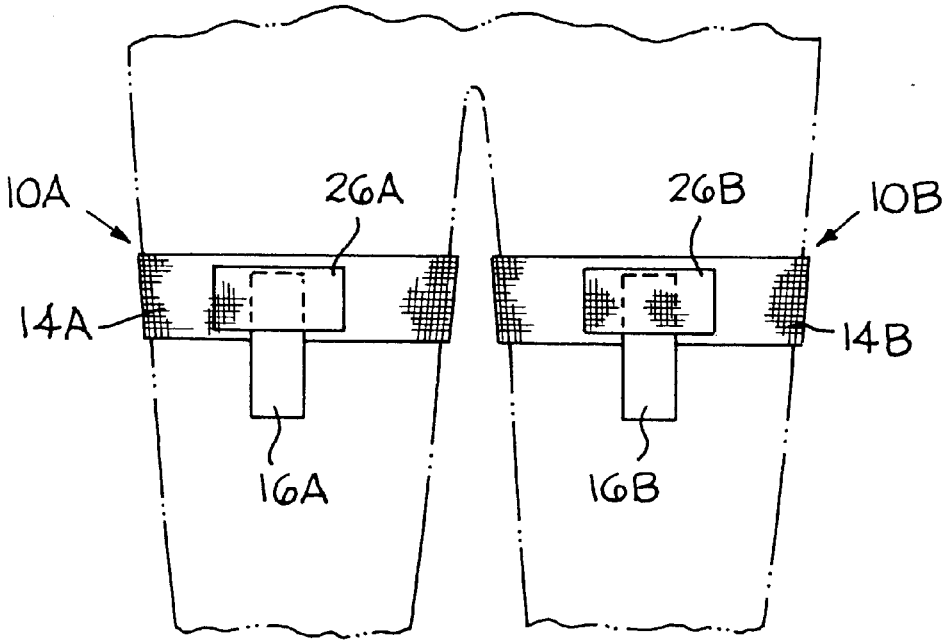
FIG. 2 is a top view of the weapon holder of FIG. 1.
Figure 3:
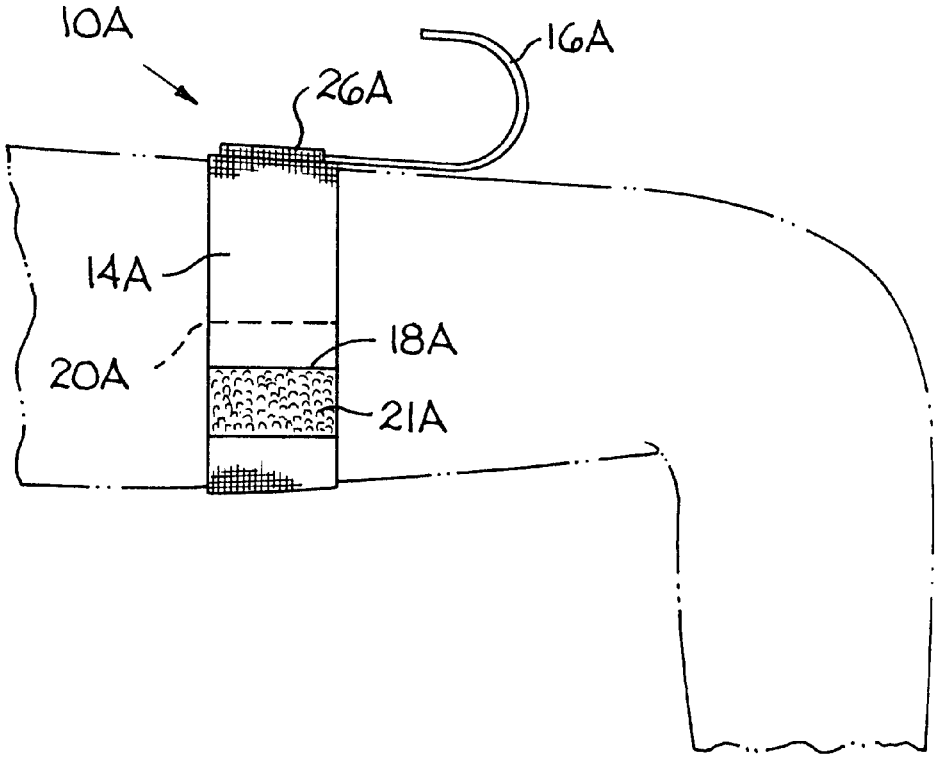
FIG. 3 is a side view of the weapon holder of FIG. 1.

As shown in FIGS. 1–3, a preferred weapon holder 8 made in accordance with the present invention is comprised of a pair of identical assemblies 10A, 10B, each of which is adapted to be secured to an individual's thigh. Secured to an individual's thighs, these two assemblies 10A, 10B form a convenient holder for supporting a rifle or other weapon in a position across the individual's lap. As shown in FIG. 1, a hunter sitting in a tree stand may rest his rifle 12 (indicated in phantom) in the holder 8 across his lap, thus freeing his hands for other tasks, such as eating, drinking, or warming the hands. However, the position of the rifle 12 makes it readily accessible to the hunter should game suddenly approach.

Figure 4:
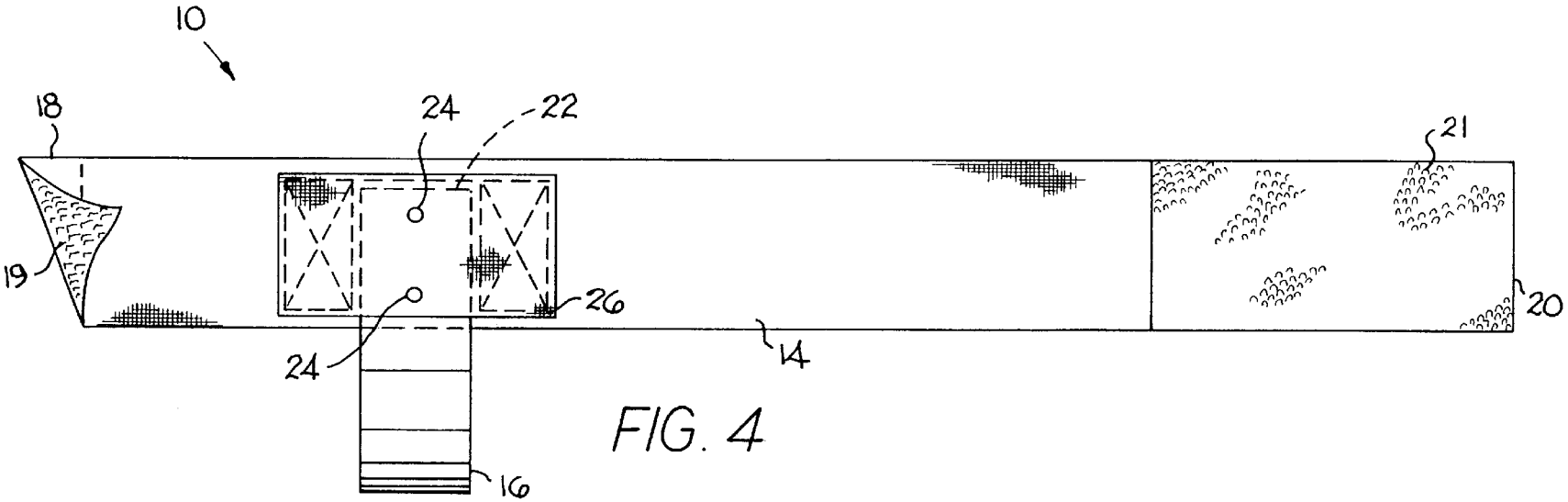
FIG. 4 is a top view of one assembly of the weapon holder of FIG. 1 detached from the hunter and laid flat.

FIG. 4 shows a preferred assembly 10 made in accordance with the present invention. This preferred assembly 10 is essentially comprised of a strap 14 and a hook 16. The hook 16 actually receives the rifle or weapon while the strap 14 serves as a means of securing the hook 16 to a wearer's thigh. As such, the strap 14 is made of a flexible material such as elastic, leather, nylon, or fabric. To secure the strap 14 around a wearer's thigh, use may be made of fabric hook and loop fasteners such as those marketed under the trademark Velcro®, which is a registered trademark of Velcro Industries, B.V. of Curacao, Netherlands. One end 18 of the strap 14 is preferably provided with hook portions 19, and the opposite end 20 is provided with loop portions 21. Once wrapped around the wearer's thigh, the hook and loop portions 19, 21 are mated to secure the strap 14 in place. This hook and loop attachment is preferred because it allows the strap 14 to be adjusted to the size of the wearer's thigh; however, other attachment means including snaps, zippers, and buckles could be used without departing from the spirit and scope of the present invention.

The hook 16 must be secured to the strap 14 such that the opening defined by the hook 16 is substantially perpendicular to the strap 14. Thus, when the strap 14 is positioned around the wearer's thigh, the hook 16 opens toward the wearer. In this preferred embodiment, the hook 16 has a flat shank portion 22 that is secured to the strap 14 by a pair of rivets 24. Additionally, a piece of material 26 (which preferably is the same material as that comprising the strap 14) is sewn across the shank portion 22 of the hook 16 to the strap 14, further securing the hook 16 to the strap 14. The hook 16 itself is preferably made of plastic, steel, or a plastic-coated steel.

Figure 5:
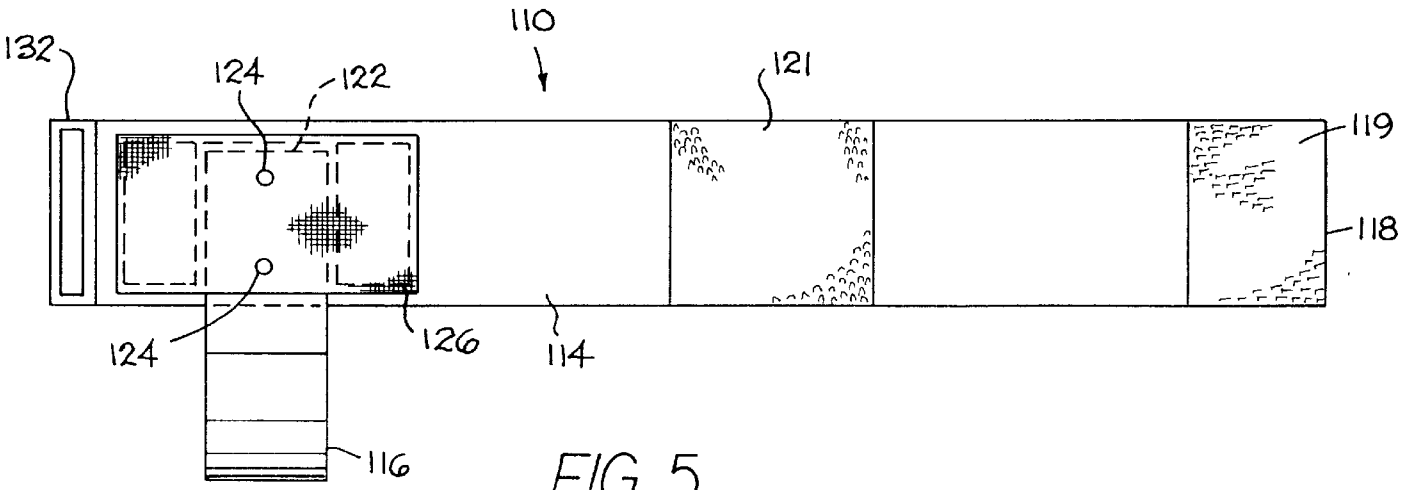
FIG. 5 is a top view of a second preferred embodiment of one assembly of the weapon holder of the present invention.

FIG. 5 shows an alternate embodiment of an assembly 110 made in accordance with the present invention. This assembly 110 again has a strap 114 and a hook 116 secured as described above to the strap 114. The strap 114 in this embodiment, however, extends from one side of the hook 116, around a wearer's thigh, and then is fed through a ring 132 stitched or otherwise secured to strap 114 on the opposite side of the hook 116. The strap 114 has hook portions 119 at its distal end 118 and has loop portions 121 along a portion of its length. In this manner, once the strap 114 has been fed through the ring 132, it can be folded over on itself so that the hook portions 119 mate with the loop portions 121, securing the strap 114 around the wearer's thigh. By threading the strap 114 through the ring 132, the wearer need only pull on the strap 114 to adjust the fit of the strap 114 around his leg.

Figure 6:
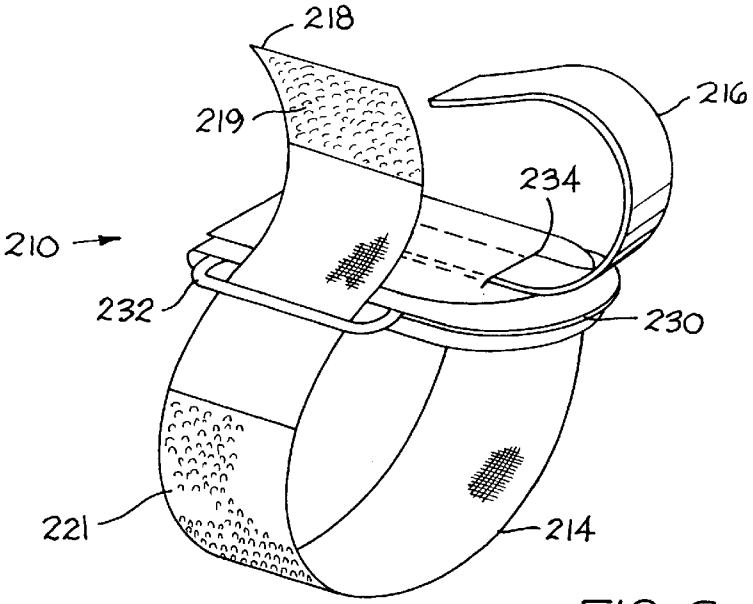
FIG. 6 is a perspective view of a third preferred embodiment of one assembly of the weapon holder of the present invention.

FIG. 6 shows another alternate embodiment of an assembly 210 in accordance with the present invention. This assembly 210 also has a strap 214 and a hook 216. However, this assembly further includes a base portion 230 that serves as the interface between the strap 214 and the hook 216. The strap 214 is secured to and extends from a first side of the base 230. After being wrapped around a wearer's thigh, the strap 214 can be threaded through a ring 232 on the opposite side of the base 230. The strap 214 has hook portions 219 at its distal end 218 and has loop portions 221 along a portion of its length. As with the embodiment shown in FIG. 5, once the strap 214 has been threaded through the ring 232, it can be folded over on itself so that the hook portions 219 mate with the loop portions 221, thereby securing the strap 214 around the wearer's thigh.

Again, the base portion serves as the interface between the hook 216 and the strap 214. Thus, the base 230 defines an internal channel 234 that receives a flat shank portion 222 of the hook 216. The shank portion 222 of the hook 216 is inserted into this channel 234 such that, when the strap 214 is secured to the wearer's thigh, the hook 216 opens toward the wearer.

Again, although hook and loop portions are a preferred means of attachment, other attachment means, including snaps, zippers, and buckles, could be used without departing from the scope of the present invention.

Figure 7:
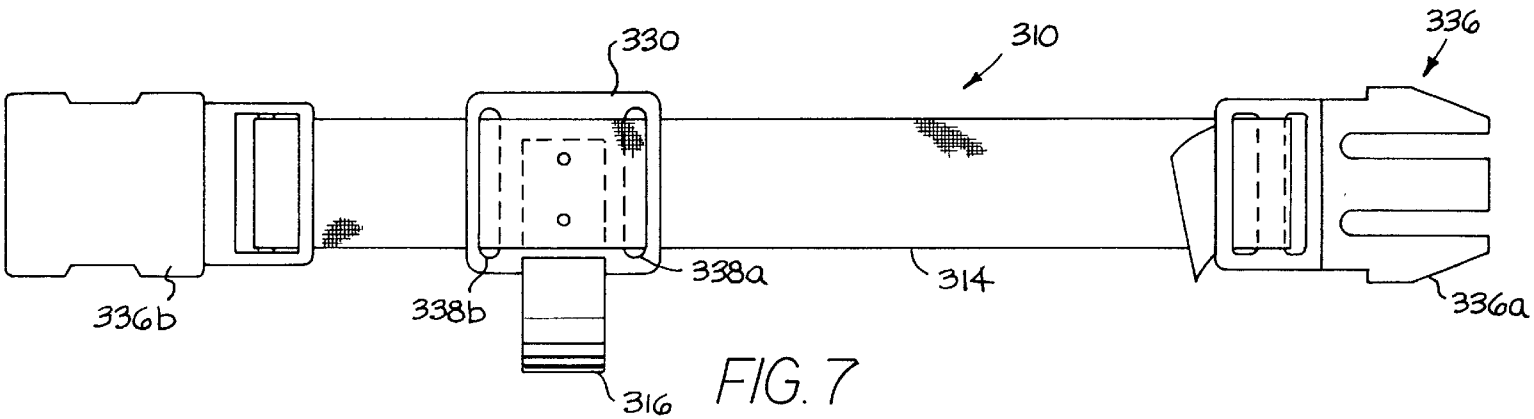
FIG. 7 is a top view of a fourth preferred embodiment of one assembly of the weapon holder of the present invention.

For example, as shown in FIG. 7, in another preferred embodiment of the weapon holder of the present invention, the strap 314 is secured around the wearer's thigh using a buckle 336. The male portion 336*a* of the buckle 336 is adjustably secured to one end of the strap while the female portion 336*b* of the buckle is secured to the opposite end of the strap.

Also, the embodiment in FIG. 7 includes an adjustable hook 316. This hook 316 includes a flat base portion 330. This base portion 330 defines two substantially identical slots 338*a* and 338*b* which are located at opposite ends of the base portion 330. The strap 314 of this assembly 310 passes through these slots 338*a*, 338*b*, thereby allowing the hook 316 to be moved along the length of the strap 314. Once the assembly 310 has been secured around the wearer's thigh, the hook 316 can be moved to a comfortable and convenient position for receiving the weapon.

The weapon holder of the present invention thus provides a convenient, readily accessible location where a hunter can place his weapon, thereby freeing his hands for other tasks.

It is understood that changes may be made in the construction and arrangement of the various components of the present invention without departing from the spirit or scope of the invention as described herein.

What is claimed is:

1. A weapon holder comprising substantially identical first and second assemblies, each of said assemblies associated with the thigh of an individual and comprising:

a strap adapted to be worn around one thigh of an individual, said strap defining a length; and a hook, having a shank portion and defining an opening, said shank portion being secured to said strap such that said opening is substantially perpendicular to the length of said strap;

wherein said first assembly can be worn around one thigh of an individual, and said second assembly can be worn around a second thigh of the individual, said first and second assemblies cooperating to allow a weapon to be positioned across the lap of the individual and received by the hooks of the first and second assemblies.

2. A weapon holder as recited in claim 1, wherein the shank portion of each said hook is secured to the strap by one or more rivets extending through said hook and said strap.

3. A weapon holder as recited in claim 2, wherein a piece of material is sewn to each said strap across the shank portion of each said hook, thereby covering said one or more rivets and further securing said hook to said strap.

4. A weapon holder as recited in claim 1, wherein a first end of each said strap is provided with fabric hook portions, and a second end of each said strap is provided with fabric loop portions, said hook portions and said loop portions adapted to mate, thereby allowing said first and second assemblies to be secured around said individual's thighs.

5. A weapon holder as recited in claim 1, each of said first and second assemblies further comprising:

a ring secured to a first end of said strap;

a plurality of fabric hook portions secured to said strap near a second end of said strap; and a plurality of fabric loop portions secured to said strap along a portion of the length of said strap;

wherein said strap can be wrapped around an individual's thigh, threaded through said ring and folded over on itself, thereby allowing said hook portions and said loop portions to mate to secure each said assembly around said individual's thigh.

6. A weapon holder as recited in claim 1, wherein a first end of each said strap is provided with a male buckle portion, and a second end of each said strap is provided with a female buckle portion, said male and female buckle portions being adapted to mate, thereby allowing said first and second assemblies to be secured around said individual's thighs.

7. A weapon holder comprising substantially identical first and second assemblies, said first assembly being adapted to be worn around one thigh of an individual, and said second assembly adapted to be worn around a second thigh of the individual, said first and second assemblies cooperating to allow a weapon to be positioned across the lap of the individual and held by said first and second assemblies, each of said assemblies comprising:

a strap adapted to be worn around the individual's thigh and defining a length;

a hook, having a shank portion and defining an opening;

a base portion adapted to receive and secure the shank portion of said hook and having first and second sides, a first end of said strap being secured to and extending from the first side of said base portion;

a ring secured to and extending from the second side of said base portion;

a plurality of fabric hook portions secured to said strap near a second end of said strap; and a plurality of fabric loop portions secured to said strap along a portion of the length of said strap;

wherein said strap can be wrapped around one thigh of the individual, threaded through said ring and folded over on itself, thereby allowing said hook portions and said loop portions to mate, thereby securing each said assembly around the thigh of the individual.

8. A weapon holder comprising substantially identical first and second assemblies, each of said assemblies comprising:

a strap adapted to be worn around an individual's thigh and defining a length; and a hook defining an opening and including a flat base portion, said base portion defining two slots, said strap being threaded through said slots, and said hook being oriented relative to said strap such that said opening is substantially perpendicular to the length of said strap;

wherein said first assembly can be worn around one thigh of an individual, and said second assembly can be worn around a second thigh of the individual, said first and second assemblies cooperating to allow a weapon to be positioned across the lap of the individual and received by the hooks of the first and second assemblies.

9. A weapon holder as recited in claim 8, wherein a first end of each said strap is provided with fabric hook portions, and a second end of each said strap is provided with fabric loop portions, said hook portions and said loop portions adapted to mate, thereby allowing said first and second assemblies to be secured around said individual's thighs.

10. A weapon holder as recited in claim 8, wherein a first end of each said strap is provided with a male buckle portion, and a second end of each said strap is provided with a female buckle portion, said male and female buckle portions being adapted to mate, thereby allowing said first and second assemblies to be secured around said individual's thighs.

11. A weapon holder for positioning of a weapon while allowing an individual, in a sitting position and forming a lap, complete use of his hands, comprising:

a pair of straps, one of said straps being wrapped around one thigh of the sitting individual, and the second of said straps being wrapped around a second thigh of the sitting individual; and a pair of weapon securing elements each associated with a respective one of said straps, each of said securing elements having a hook configuration defining a concavity and a distal end, and having a shank portion secured to said respective strap, each of said concavities being oriented such that the distal end of said securing element is pointed essentially up the thigh of the individual, thereby allowing the weapon to be positioned across the individual's lap and within said concavities.

12. A weapon holder as recited in claim 11 in which said shank portion is secured to the respective strap by one or more fasteners.

13. A weapon holder as recited in claim 11 in which said shank portion is secured to the respective strap by strips of material sewn to said strap and across said shank portion.

14. A weapon holder as recited in claim 11 in which each said strap has hook and loop fastener elements respectively positioned adjacent first and second ends of the strap, thereby allowing the strap to be secured around the thigh of the individual.

* * * * *